US006375686B1

(12) United States Patent
Kim

(10) Patent No.: US 6,375,686 B1
(45) Date of Patent: Apr. 23, 2002

(54) METHOD AND APPARATUS FOR TREATING SPOTS ON A SPOTTING TABLE WITH A SPOTTING GUN

(76) Inventor: Su Heon Kim, 1200 E. Algonquin, Schaumburg, IL (US) 60142

( * ) Notice: Subject to any disclaimer, the term of this patent is extended or adjusted under 35 U.S.C. 154(b) by 0 days.

(21) Appl. No.: 09/566,362

(22) Filed: May 8, 2000

(51) Int. Cl.[7] ..... D06B 5/22
(52) U.S. Cl. ..... 8/149.3; 68/5 A; 68/240
(58) Field of Search ..... 8/149.3; 68/240, 68/222, 5 A, 5 B, 6; 15/405

(56) References Cited

U.S. PATENT DOCUMENTS

| | | | | |
|---|---|---|---|---|
| 1,717,086 A | | 6/1929 | Binks | |
| 1,910,673 A | | 5/1933 | Bramsen | |
| 2,783,092 A | * | 2/1957 | Gavin et al. | 15/405 X |
| 2,787,900 A | * | 4/1957 | Chrisman | 68/222 X |
| 3,030,792 A | * | 4/1962 | Bader | 68/240 |
| 3,512,379 A | * | 5/1970 | Buckley et al. | 68/240 |
| 4,214,709 A | | 7/1980 | Scull et al. | |
| 4,354,364 A | | 10/1982 | Holder et al. | |
| 4,437,614 A | | 3/1984 | Garcowski | |
| 4,765,159 A | | 8/1988 | Maeda et al. | |
| 5,253,378 A | * | 10/1993 | Jung, Jr. | 68/240 X |
| 5,301,880 A | | 4/1994 | Benian | |
| 5,327,751 A | | 7/1994 | Biagi | |
| 5,591,236 A | | 1/1997 | Roetker | |
| 5,630,847 A | | 5/1997 | Roetker | |
| 5,632,780 A | | 5/1997 | Siklosi | |
| 5,849,039 A | | 12/1998 | Sadlowski | |
| 5,891,197 A | | 4/1999 | Young et al. | |
| 5,908,473 A | | 6/1999 | Weller et al. | |
| 6,021,652 A | | 2/2000 | Walker | |

FOREIGN PATENT DOCUMENTS

| | | |
|---|---|---|
| EP | 0255421 B1 | 11/1994 |
| EP | 0420103 B1 | 6/1996 |
| EP | 0557257 B1 | 12/1996 |
| EP | 0679754 B1 | 9/1998 |
| WO | WO97/00738 | 1/1997 |
| WO | WO97/06723 | 2/1997 |
| WO | WO97/26821 | 7/1997 |

* cited by examiner

*Primary Examiner*—Philip Coe
(74) *Attorney, Agent, or Firm*—Pyle & Piontek

(57) ABSTRACT

A method and apparatus are provided to regulate the flow of compressed air and steam utilized in treating spots in cloth or clothes with a spotting table having a spotting gun. The method comprises first turning on the steam or compressed air of the spotting table using conventional foot valves and next throttling the steam or compressed air flow to a desired level by manipulating a valve provided on the spotting gun, which valve can be manipulated and set by the spotting gun operator with the same hand holding the spotting gun.

25 Claims, 4 Drawing Sheets

METHOD AND APPARATUS FOR TREATING SPOTS ON A SPOTTING TABLE WITH A SPOTTING GUN

BACKGROUND OF THE INVENTION

It is known to locally pretreat spotted cloth and clothing in the dry cleaning. industry prior to subjecting the cloth or clothing to a subsequent, overall dry cleaning process. Frequently, the pretreatment of spots is done on what is known in the dry cleaning industry as a spotting table or board (as used herein table will include "board"). A spotting table generally is supported above the floor, has an arm-shaped table, shaped something like an ironing board, and is carried at a sufficient height to keep the clothes off the ground and at a convenient height for the operator. The top of the table has an edge or rim and/or an opening to form a drainage as will become more apparent from the discussion below. The clothes are placed on the table, for example, with a skirt or sleeve being positioned or arranged to make its outer spotted surface accessible.

The spotting table is used in conjunction with various spot treating liquids or treatments which are applied to the cloth to remove a spot. To assist in the removal of the applied liquids or treatments and some vapors, the spotting table usually has a vacuum source therein to suck or pull off the excess fluids and some vapors. Also to assist in the spot removal operation in loosening the spot and/or drying the treated spot, both steam and compressed air are provided. To control the vacuum, steam and compressed air, usually three foot valves are provided, one each for vacuum, air and steam. Generally, these valves are foot operated, pressing them down to turn them on and letting the valves up to turn them off. Foot operation of the valves is mandatory as the operators hands are needed to place and hold the cloth or clothes and to administer the various spot removing treatments. The vacuum valve is separately lead to the vacuum table, while the steam and air lines after their respective valves, are manifolded together to a common hose which leads up to a spotting gun. The spotting gun has a handle which is held by the operator and leads to a nozzle. The nozzle is replaceably thread on the end of the delivery pipe running through the handle and usually is shaped to provide a fan shaped spray discharge of compressed air or steam.

The disadvantage of this type design is that it was difficult to control the flow of compressed air and/or steam discharge using their foot valves and to regulate and control the amount of air or steam being used at the particular time. As the size and type of spot can greatly vary, one needs various amounts of steam and/or compressed air at various times to pretreat, treat, remove, and dry the spot. The control and regulation are particularly difficult for operators without a great deal of experience in operating a spotting table. The foot valves cannot be easily regulated, and it becomes tiring to stand on one heel and the other foot, while using the toe end of the one foot to try to regulate the flow of the steam or air to something less than full flow. While experienced operators have the knack for doing so, less experienced and novice operators have difficulty in doing so. Even for the experienced operator, use of the prior art spotting table can become tiring for these reasons.

SUMMARY OF THE INVENTION

The present invention is for a method and apparatus for easily regulating the flow of steam and/or compressed air for the spotting gun of a spotting table. The method comprises the step of turning on the flow of steam or air at the spotting table and a second step of regulating the flow to a desired flow rate for the particular phase of the spot removal process being carried out. Preferably, the step of regulating is accomplished manually to a set but variable flow rate or valve position as desired and/or needed.

The apparatus of the present invention is utilized in conjunction with a conventional spotting table, and comprises a spotting gun and an adjustable throttling means located between the discharge of the foot valves for air and steam on one part and the discharge of the nozzle of the spotting gun on the other part. Preferably this throttling means is located to be easily manually adjustable by the operator, and in the preferred form is located on the handle of the spotting gun so that it may be adjusted by one of the fingers or thumb of the hand of the operator holding the spotting gun. The throttle means may take the form of a ball or other type valve which is connected between the source of air/steam and the spotting gun nozzle, and has a trigger or handle manipulated by the operator. The valve is of the type that can be set to any position between fully open and fully closed and retains the set position until changed again by the operator. Thus, the operator can merely stand fully on the foot valve for the steam or supply with one foot, while using the other of his/her other feet to support his/herself, using one hand to hold the spotting gun while setting the throttle means or valve to a desired position with the same one hand, use the spotting gun, but yet have the other hand free to adjust the cloth/clothes and/or apply spot removing treatments. This new procedure is less tiring even for an experienced operator.

OBJECTS OF THE INVENTION

It is an object of the present invention to provide a method for treating spots in cloth or clothes using air and/or steam in a controlled flow.

Another object of the present invention is to provide a means for controlling the flow of air and/or steam to a spotting gun.

Still another object of the present invention is to provide a method for controlling the flow of air or steam to a spotting gun which does not depend upon varying the position of a foot valve of a spotting table.

Still another object of the present invention is to provide an apparatus for carrying out the method of the present invention.

A still further object of the invention is to provide a throttle means for regulating the flow of steam and/or air supplied from the foot valves of a spotting table.

A further object is to provide a valve on a spotting gun for controlling the flow of steam and/or air used by a spotting table.

Still a further object is to provide a manually operable valve on a spotting gun that may be manipulated by the hand of the operator holding the spotting gun.

These and other objects of the present invention will become apparent from the accompanying drawings and the following written description.

BRIEF DESCRIPTION OF THE DRAWINGS

FIG. 4A is a partial elevational view showing a ball valve for the spotting gun.

DESCRIPTION OF THE PREFERRED EMBODIMENTS

Figure 1:
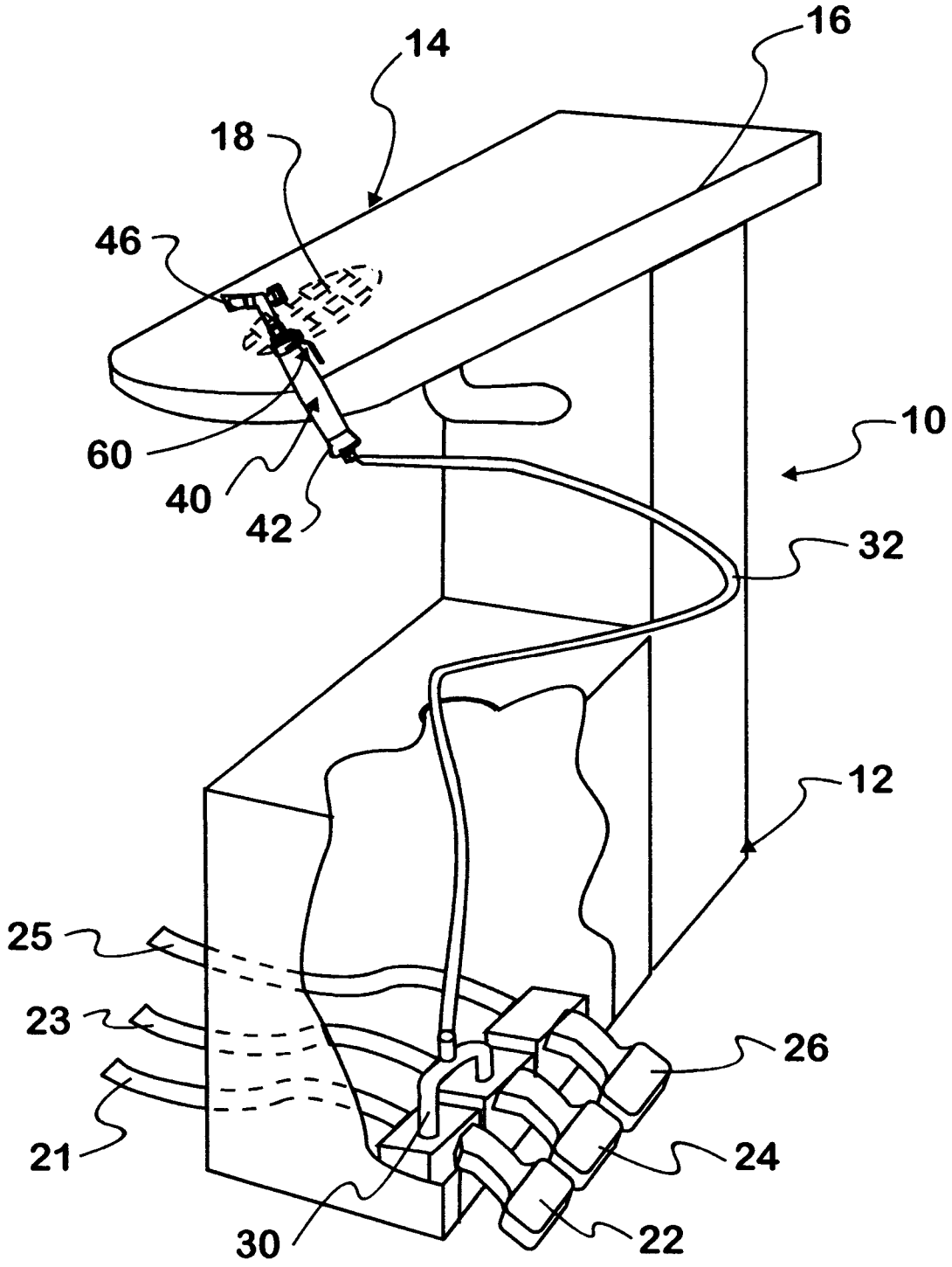
FIG. 1 is a schematic diagram of the spotting table and a spotting gun of the method and apparatus of the present invention.
Figure 2:
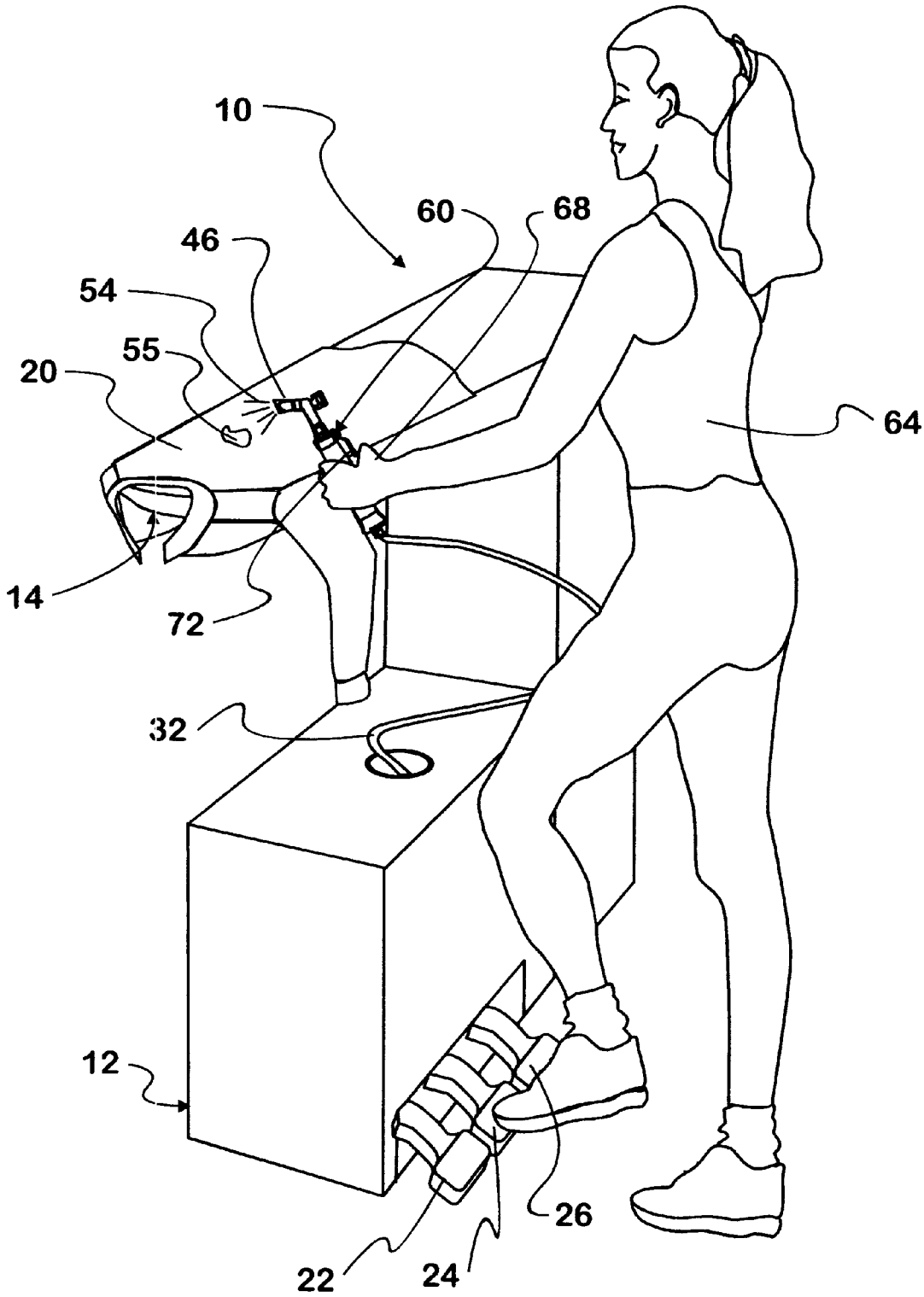
FIG. 2 is a schematic diagram showing the method and apparatus of the present invention being used to pretreat a spot.

Referring to FIGS. 1 and 2, pretreatment of spotted cloth and clothing in the dry cleaning industry prior to subjecting the cloth or clothing to a subsequent, overall dry cleaning process is done on what is known in the dry cleaning industry as a spotting table or board (as used herein table will include "board") 10. A spotting table generally is supported above the floor by a base 12 and has an arm-shaped table 14, shaped something like an ironing board, carried at a sufficient height to keep the clothes off the ground and at a convenient height for the operator (see FIG. 2). The top of the table has an edge or rim 16 and/or an opening to form a drainage 18 as will become more apparent from the discussion below. The clothes 20 (FIG. 2) are placed on the table 14, for example, with a skirt or sleeve being positioned or arranged to make its outer spotted surface accessible.

The spotting table is used in conjunction with various spot treating liquids or treatments which are applied to the cloth to remove a spot. To assist in the removal of the applied liquids and some vapors, the spotting table usually has a vacuum source (not shown—via hose 25) therein to suck or pull off the excess fluids and some vapors. Also to assist in the spot removal operation in loosening the spot and/or drying the treated spot, both steam (hose 23) and compressed air (hose 21) are provided. To control the vacuum steam and compressed air, usually three foot valves 22, 24 and 26 are provided, one each for vacuum (26), air (22) and steam (24). Generally, these valves are foot operated, pressing them down to turn them on and letting the valve up to turn them off. Foot operation of the valves is mandatory as the operators hands are needed to place and hold the cloth or clothes and to administer the various spot removing treatments. The vacuum valve is separately lead (not shown) to the vacuum table opening 18, while the steam and air lines after these respective valves are manifolded together at 30 to a common hose 32 which leads up to a spotting gun 40. The spotting gun has a handle 42 which is held by the operator (see FIG. 2) and leads to a nozzle 46. The nozzle 46 is replaceably thread on the end of the delivery pipe 50 running through the handle 42 (see FIG. 3) and usually is shaped to provide a fan shaped spray 54 (FIG. 2) discharge of compressed air or steam.

In the method and apparatus of the present invention, it is desirous to control the flow of compressed air and/or steam discharge using the foot valves and to subsequently regulate and control the amount of air or steam being used at the particular time. As the size and type of spot 55 can greatly vary, one needs various amounts of steam and/or compressed air at various times to pretreat, treat, remove, and dry the spot. The control and regulation with only the prior art foot valves are particularly difficult for operators without a great deal of experience in operating a spotting table. The foot valves cannot be easily regulated, and it becomes tiring to stand on one heel and the other foot, while using the toe end of the one foot to try to regulate the flow of the steam or air to something less than full flow. While experienced operators have the knack for doing so, less experienced and novice operators have difficulty in doing so. Even for the experienced operator, use of the prior art spotting table with a prior art spotting gun can become tiring for these reasons. It is much easier to fully stand on the valve to hold it fully open than to try to just maintain it partially open.

The present invention method and apparatus provides for easily regulating the flow of steam and/or compressed air from the spotting gun of a spotting table. The method comprises the first step of turning on the flow of steam or air, usually at the foot valve of the spotting table, and a second step of regulating the flow to a desired flow rate for the particular size or phase of the spot removal process being carried out. Preferably, the step of regulating is accomplished manually to a set or determined but variable flow rate or valve position as desired and/or needed.

Figure 3:
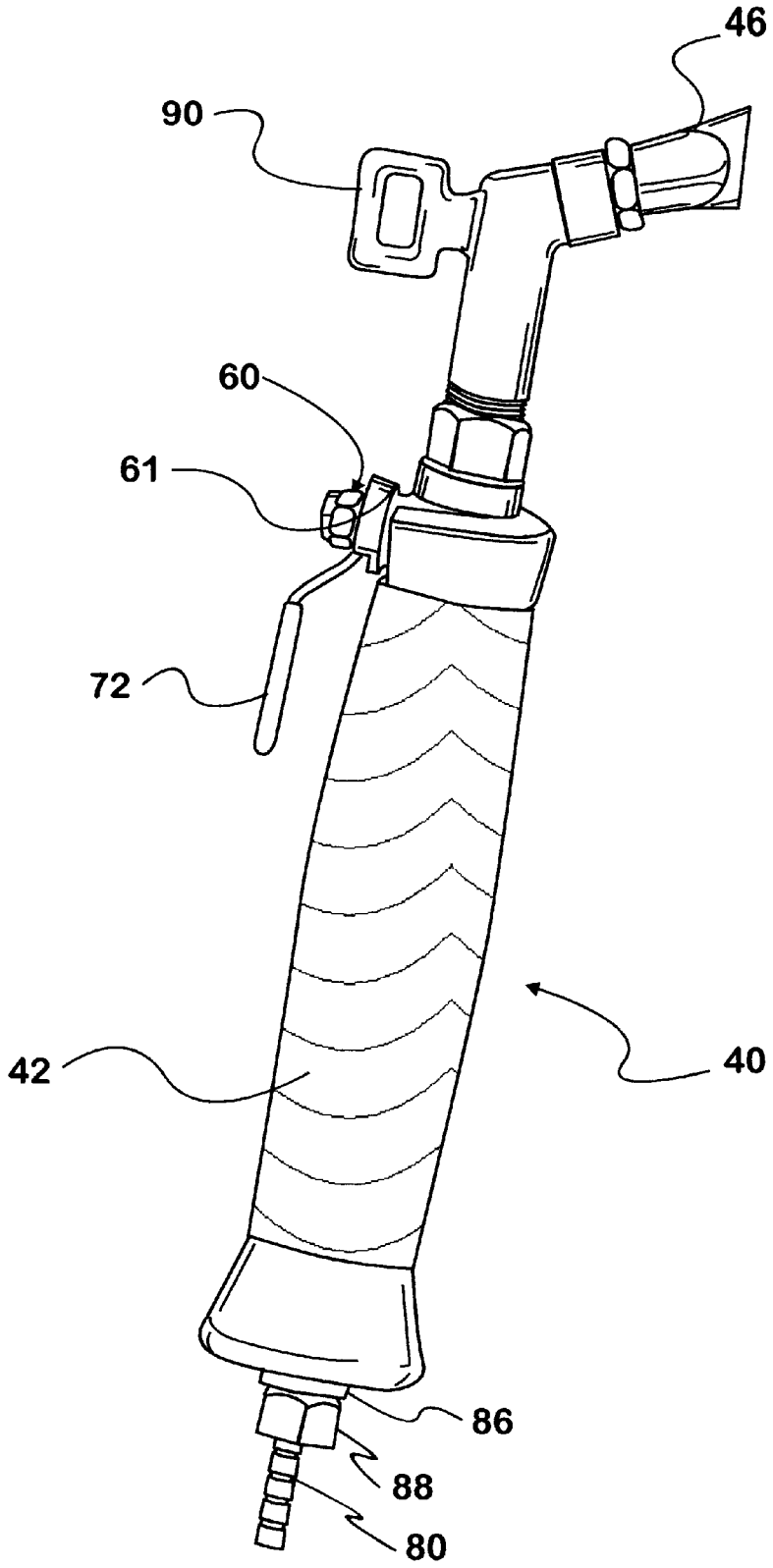
FIG. 3 is an exploded view of the spotting gun shown in FIGS. 1 and 2.
Figure 4:
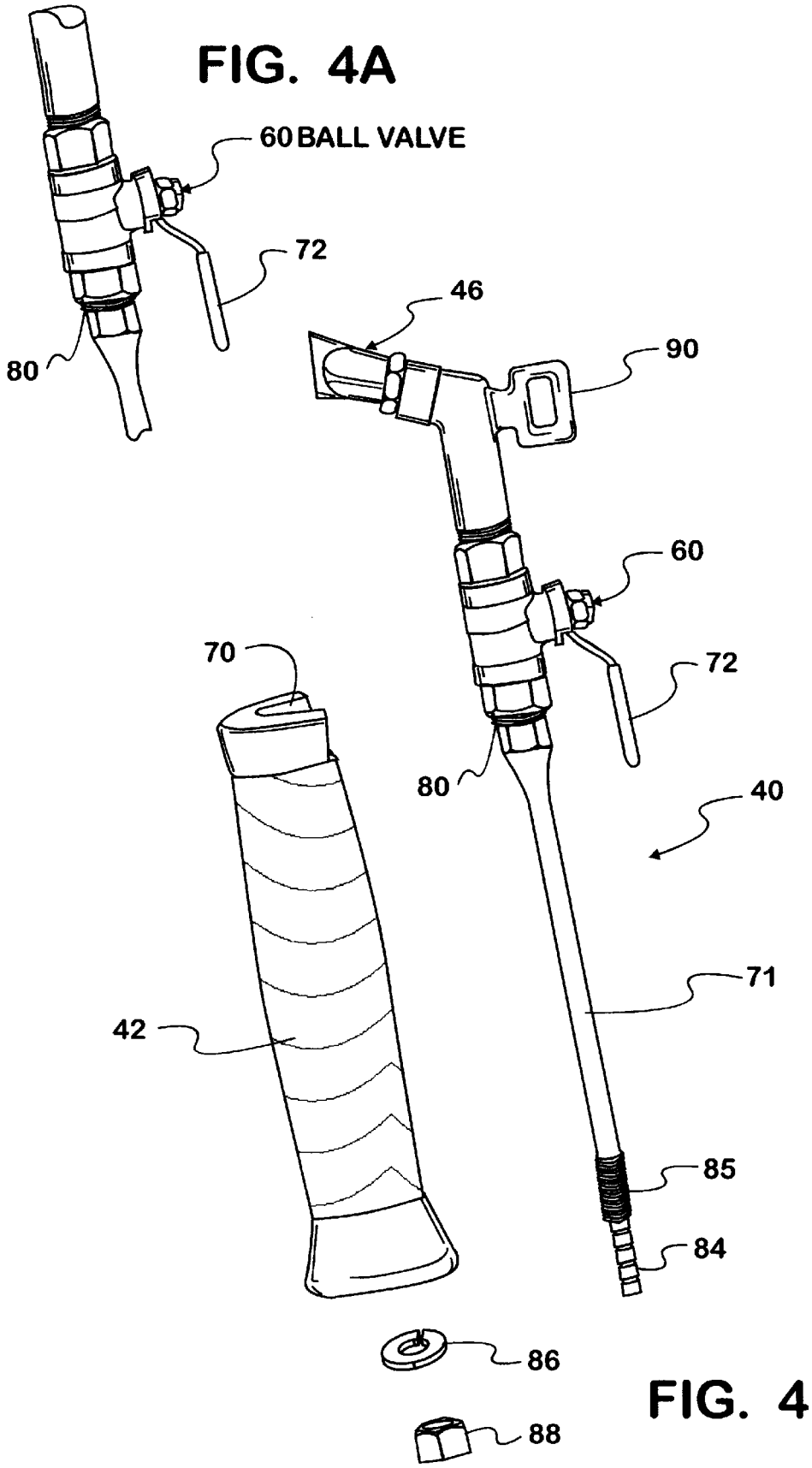
FIG. 4 is an elevational view of the assembled spotting gun of the present invention.

The apparatus of the present invention is utilized in conjunction with the spotting table 19, and as better shown in FIGS. 3 and 4 comprises an adjustable throttling means 60 located between the discharge of the foot values for air and steam 22 and/or 24 on one part and the discharge of the nozzle 46 of the spotting gun 40 on the other part. Preferably this throttling means is located to be easily manually adjustable by the operator 64, and in the preferred form is located on the handle 42 of the spotting gun 40 so that it may be adjusted by one of the fingers or thumb 68 of the hand of the operator actually holding the spotting gun 40. The handle 42 is hollow having an opening 70 to accommodate a delivery pipe 71, running up its center. The throttle means may take the form of a ball, sleeve or other type mechanical valve which is connected between the source of air/steam and the spotting gun nozzle, and has a trigger or handle manipulated 72 by the operator. The valve can be directly mechanically operated or controlled by a pneumatic hydraulic or electrical or electronic system. For example, there could be two control buttons, one to open the valve and the other to close it, with appropriate electronic or electrical means provided to move the valve in response to pushing the buttons. The valve is of the type that can be set to any position between fully open and fully closed and retains the set position until subsequently changed again by the operator. Thus, the operator can merely stand fully on the foot valve for the steam or supply with one foot, while using the other of his/her other feet to support his/herself, using one hand to hold the spotting gun 40 while setting the throttle means or valve 60 to a desired position, use the spotting gun, but yet have the other hand free to adjust the cloth/clothes and/or apply spot removing treatments. The spotting gun can have indicia thereon such as a scale or markings to indicate the throttling means relative position (relative to full open to closed) to provide repeatability in achieving a desired setting. The indicia may be a pointer or the lever, itself, and marks on the gun, or vice versa, or may just be relative clock positions for the lever or other portion of the throttle means or valve to another portion of the gun. For example, a 6 o'clock position of the valve's lever could be full on and 9 o'clock position being full off. As shown, the delivery pipe may be threaded at 80 to accommodate the throttle means and have a barbed portion 84 to accommodate receipt of the end of the hose 32. The portion of the delivery pipe 71 above the barb 84 is threaded at 85 to receive a washer 86 and nut 88 to retain the delivery pipe in the handle.

As can be seen from FIGS. 3 and 4, the delivery pipe 71 is inserted into the top opening of 70 of the handle 42 and the washer 86 and nut 88 assembled on the threaded portion 85. The opening in the handle 70 is sized to accommodate the valve 60 with its lever 72 extending therefrom. An opening or hook 90 is provided on the top 89 of the gun to hang up the gun on the spotting table when not being used by the operator.

In operation, the operator may press on the appropriate foot valve be it 22, 24 or 26. When air or steam is desired, the operator presses the appropriate valve 22 or 24 with his or her foot and sets the desired flow of steam or air using the throttle valve 60. He or she, of course, can vary the valve setting of valve 60 using the lever 72 as needed to pretreat the spots and the adjustment will be retained until the operator should again change it.

While the preferred method and apparatus of the present invention have been disclosed and described, it should be understood that alternative and equivalent steps and elements are covered by the accompanying claims.

What is claimed is:

1. A method of treating a spot in cloth on a spotting table including a spotting gun and source of steam and compressed air, comprising the step of:

providing a flow of one of said steam and compressed air from the spotting table to the spotting gun, throttling one of said steam and compressed air after it enters but before it exits the spotting gun, and utilizing the throttled one of said steam and compressed air to treat said spot.

2. A method as in claim 1, wherein the step of throttling comprises the step of alternatively throttling each of said steam and compressed air.

3. The method of claim 1, wherein said spotting table includes foot valves for each of said steam and compressed air, and said providing step comprises alternatively fully stepping on said foot valve for one of said steam or compressed air so it is in the fully open position.

4. The method of claim 3, wherein said throttling step occurs downstream of said providing step.

5. The method of claim 3, wherein said throttling step occurs downstream of said foot valves.

6. A method of treating a spot in cloth on a spotting table including a spotting gun and source of steam and compressed air, comprising the step of:

providing a flow of one of said steam and compressed air from the spotting table to the spotting gun, throttling one of said steam and compressed air before it exits the spotting gun, utilizing the throttled one of said steam and compressed air to treat said spot, and said throttling step occurring at said spotting gun.

7. The method of claim 1, wherein said throttling step occurs upstream of the exiting of one of said steam and compressed air from said spotting gun.

8. The method of claim 1, wherein said providing step is carried out by stepping on a foot valve to a fully open position and said throttling step may be carried out by throttling the flow of one of said steam and air to anywhere in between zero and full flow.

9. A method of treating a spot in cloth on a spotting table including a spotting gun and source of steam and compressed air, comprising the step of:

providing a flow of one of said steam and compressed air from the spotting table to the spotting gun, throttling one of said steam and compressed air before it exits the spotting gun, utilizing the throttled one of said steam and compressed air to treat said spot, and said spotting gun carrying a throttle valve and said throttling step is carried out by manually setting the throttle valve to a desired position with the hand of the operator holding the spotting gun.

10. A spotting table for treating spots prior to dry cleaning, comprising a table, vacuum source connection, a steam source connection, a compressed air source connection, a foot valve for each of said vacuum, steam and compressed air, said foot valves for said compressed air and steam having discharges commonly connected, a spotting gun connected to said commonly connected compressed air and steam discharges, said spotting gun having a discharge for said compressed air and steam, and a throttle means located between said foot valves for said compressed air and steam and said discharge of said spotting gun, whereby the flow of air and/or steam from said foot valves for air and/or steam may be throttled to a desire rate of flow by said throttle means.

11. A spotting table for treating spots prior to dry cleaning, comprising a table, vacuum source connection, a steam source connection, a compressed air source connection, a foot valve for each of said vacuum, steam and compressed air, said foot valves for said compressed air and steam having discharges commonly connected, a spotting gun connected to said commonly connected compressed air and steam discharges, said spotting gun having a discharge for said compressed air and steam, and a throttle means located between said foot valves for said compressed air and steam and said discharge of said spotting gun, said throttle means being located on said spotting gun, whereby the flow of air and/or steam from said foot valves for air and/or steam may be throttled to a desired rate of flow by said throttle means.

12. An apparatus as in claim 10, wherein said throttle means is operable by the hand of an operator that holds said spotting gun.

13. An apparatus as in claim 10, wherein said throttle means comprises a valve.

14. An apparatus as in claim 13, wherein said valve is located between said foot valves for said compressed air and steam and the discharge of said spotting gun.

15. A spotting table for treating spots prior to dry cleaning, comprising a table, vacuum source connection, a steam source connection, a compressed air source connection, a foot valve for each of said vacuum, steam and compressed air, said foot valves for said compressed air and steam having discharges commonly connected, a spotting gun connected to said commonly connected compressed air and steam discharges, said spotting gun having a discharge for said compressed air and steam, and a throttle means located between said foot valves for said compressed air and steam and said discharge of said spotting gun, whereby the flow of air and/or steam from said foot valves for air and/or steam may be throttled to a desired rate of flow by said throttle means, wherein said throttle means comprises a valve, said valve being located between said foot valves for said compressed air and steam and the discharge of said spotting gun, said valve being a ball valve having a body, an operable handle and a valve member which may be positioned on said body by said handle into an open position, a closed position or anywhere in between.

16. A spotting table for treating spots prior to dry cleaning, comprising a table, vacuum source connection, a steam source connection, a compressed air source connection, a foot valve for each of said vacuum, steam and compressed air, said foot valves for said compressed air and steam having discharges commonly connected, a spotting gun connected to said commonly connected compressed air and steam discharges, said spotting gun having a discharge for said compressed air and steam, and a throttle means located between said foot valves for said compressed air and steam and said discharge of said spotting gun, whereby the flow of air and/or steam from said foot valves for air and/or steam may be throttled to a desired rate of flow by said throttle means, said valve being located between said foot valves for said compressed air and steam and the discharge of said spotting gun, said spotting gun including indicia to show the relative flow through said valve.

17. An apparatus as in claim 15, wherein a valve is located on said spotting gun between the inlet to and discharge from said spotting gun, and said handle extends from said spotting gun so as to be operable by the operator holding the spotting gun.

18. An apparatus as in claim 17, wherein said valve handle is located on the spotting gun to be operable by the hand of the operator that holds the spotting gun.

19. A spotting gun for treating spots prior to dry cleaning comprising an inlet adapted to be connected to a source of steam and compressed air, a discharge from said spotting gun for applying steam or compressed air to the spot, and a throttle means located on the spotting gun between its said inlet and discharge to throttle the flow of steam and air supplied to the gun to a desired level between zero and full flow.

20. An apparatus as in claim 19, wherein said throttle means is operable by the hand of an operator that holds said spotting gun.

21. An apparatus as in claim 19, wherein said throttle means comprises a valve.

22. An apparatus as in claim 21, wherein said valve is a ball valve having a body, an operable valve handle and a valve member which may be positioned on said body by said valve handle into an open position, a closed position or anywhere in between.

23. An apparatus as in claim 21, wherein said valve includes indicia to show the relative flow through said valve.

24. A spotting table for treating spots prior to dry cleaning, comprising a table, vacuum source connection, a steam source connection, a compressed air source connection, a foot valve for each of said vacuum, steam and compressed air, said foot valves for said compressed air and steam having discharges commonly connected, a spotting gun connected to said commonly connected compressed air and steam discharges, said spotting gun having a discharge for said compressed air and steam, and a throttle means located between said foot valves for said compressed air and steam and said discharge of said spotting gun, whereby the flow of air and/or steam from said foot valves for air and/or steam may be throttled to a desired rate of flow by said throttle means, said throttle means comprising a valve, said spotting gun having a handle and said valve is located on said handle downstream of the discharge for said compressed air and steam for said spotting gun.

25. An apparatus as in claim 19, wherein a valve is located on said spotting gun between the inlet to and discharge from said spotting gun, said valve having a handle thereon, and said valve handle extends from said spotting gun so as to be operable by the operator holding the spotting gun.

* * * * *

UNITED STATES PATENT AND TRADEMARK OFFICE

CERTIFICATE OF CORRECTION

PATENT NO. : 6,375,686 B1
DATED : April 23, 2002
INVENTOR(S) : Su Heon Kim

It is certified that error appears in the above-identified patent and that said Letters Patent is hereby corrected as shown below:

Column 4,
Line 17, "19" should be -- 10 --
Line 22, after "means" insert -- 60 --
Line 29, after "valve" insert -- (see FIG. 4A) --
Line 48, after "indicia" insert -- (such as shown at 61 in FIG. 3) --

Signed and Sealed this

Eighth Day of October, 2002

*Attest:*

*Attesting Officer*

JAMES E. ROGAN
*Director of the United States Patent and Trademark Office*